United States Patent [19]

Ueno et al.

[11] Patent Number: 4,823,288

[45] Date of Patent: Apr. 18, 1989

[54] DOCUMENT PROCESSOR

[75] Inventors: Hideo Ueno; Shigeto Yamada, both of Nagoya, Japan

[73] Assignee: Brother Kogyo Kabushiki Kaisha, Aichi, Japan

[21] Appl. No.: 51,402

[22] Filed: May 19, 1987

[30] Foreign Application Priority Data

May 20, 1986 [JP] Japan ..... 61-115886

[51] Int. Cl.[4] ..... B41J 5/30

[52] U.S. Cl. ..... 364/519; 400/3; 400/7

[58] Field of Search ..... 364/518–521; 400/3, 7, 15, 64

[56] References Cited

U.S. PATENT DOCUMENTS 3,895,704 7/1975 Norris ..... 400/7 X
3,915,278 10/1975 Spence et al. ..... 400/7 X
4,330,217 5/1982 Churgovich et al. ..... 364/900 X
4,556,332 12/1985 Maekawa ..... 400/3

FOREIGN PATENT DOCUMENTS 60-87085 of 1985 Japan .

*Primary Examiner*—Gary V. Harkcom
*Assistant Examiner*—H. R. Herndon
*Attorney, Agent, or Firm*—Barnes & Thornburg

[57] ABSTRACT

A document processor having a keyboard, a displaying apparatus for displaying inputted characters and symbols on a display and a control device for controlling the displaying apparatus, there is provided an improvement that permits the moving of an inputted word separated at the right margin set position on the display to the start of the succeeding display line by wordlap control, such that the separated word is displayed distinguishably on the display, for example, by blinking, in order to distinguish the separated word to an operator before moving the word to the succeeding line.

7 Claims, 6 Drawing Sheets

DOCUMENT PROCESSOR

BACKGROUND OF THE INVENTION

The present invention relates to a document processor, more specifically, it relates to an improved wordlap control which, when a word is displayed separately in two lines, wordlaps the word.

In general, in the document processor such as an English typewriter and an English word processor provided with a CRT or a liquid crystal display and the like and capable of displaying a plurality of lines, characters and symbols inputted from a keyboard are displayed in sequence and each line is returned automatically at a right margin set position.

With regard to the word separated in two lines at the right margin set position, the word is displayed with a hyphen added at the break position just before the right margin set position of the word to change the line, or the word is displayed by a wordlap processing which displays the entire word from the head display position of the new line.

In the wordlap processing of the conventional document processor, when the input character data reached to the right margin set position of the end of a print line, in spite of data inputted of whole characters of the word is not completed, input characters after the head character of the word are automatically shifted to the next line without notice.

Accordingly, in the wordlap processing of the conventional document processor, when reached to the right margin set position, wordlap processing is carried out suddenly without notice in spite of character data of the word being inputted, inputted characters are erased from the display screen and shifted to the head position of the following line, so that an operator is greatly bewildered and apprehended to neglect key-operation momentarily, resulting in a low working efficiency.

SUMMARY OF THE INVENTION

It is an object of the present invention to provide a document processor which is capable of wordlapping a word after noticing to the operator in advance prior to word-lapping the word separated in two print lines, and after inputting the end character of the word.

The document processor in accordance with the present invention is provided with, an input means for inputting data of characters and symbols, a display means for displaying characters and symbols inputted by the input means correspondingly by the print positions, a control means for controling the display means, including a display memory for storing data to be displayed by the display means, a wordlap command means for outputting a wordlap command when the data inputted at an utmost right position regulated by a right margin set position of the display means is a character other than an end character of the word, a distinguishing display command means for putputting a distinguishing display command to the display means, when receiving the wordlap command from the wordlap command means, for commanding the control means to display distinguishably the word separated and displayed in two display lines of the display means, and a wordlap control means for wordlapping the separated word after inputting the end character of the separated word.

FUNCTION OF THE INVENTION

In a document processor in accordance with the present invention, a display means for displaying a plurality of characters and symbols inputted from an input means correspondingly to print positions is provided, and when the data inputted at an utmost right position regulated by a right margin position of the display means is a character other than an end character of a word, a wordlap command is outputted from a wordlap command means. When a distinguishing display commanding means receives the wordlap command, since a distinguishing display command for commanding to display distinguishably the separated word displayed in two display lines of the display means is outputted to the display means, the separated word is displayed distinguishably by the display means.

Furthermore, after inputting the end character of the separated word, the separated word is wordlapped by the wordlap control means.

ADVANTAGE OF THE INVENTION

According to a document processor in accordance with the present invention, as described hereinabove, since a distinguishing display is performed relative to a separated word at the line feed position and separated in two lines, and the wordlap is conducted after inputting the end character of the separated word, an operator is able to notice the word to be wordlapped in advance, thus operation can be pursued efficiently at ease without being bewildered or neglecting key operation.

BRIEF DESCRIPTION OF THE DRAWINGS

FIG. 1 through FIG. 6 show an embodiment of the present invention, wherein FIG. 1 is a perspective view of an electronically controlled typewriter, FIG. 2 is a plan view of a key-board of the typewriter shown in FIG. 1, FIG. 3 is a block diagram of the control system of the typewriter shown in FIG. 1, FIGS. 4(*a*) through 4(*c*) are explanatory views showing wordlap processing of a word separated in two lines at the right margin set position schematically in sequence, and FIGS. 5(*a*) & (*b*) are flow charts showing a wordlap control routine.

DESCRIPTION OF THE PREFERRED EMBODIMENT

An embodiment of the present invention applied to an electronically controlled English typewriter including a text memory and capable of document processing will be described in the following with reference to the drawings.

Figure 1:
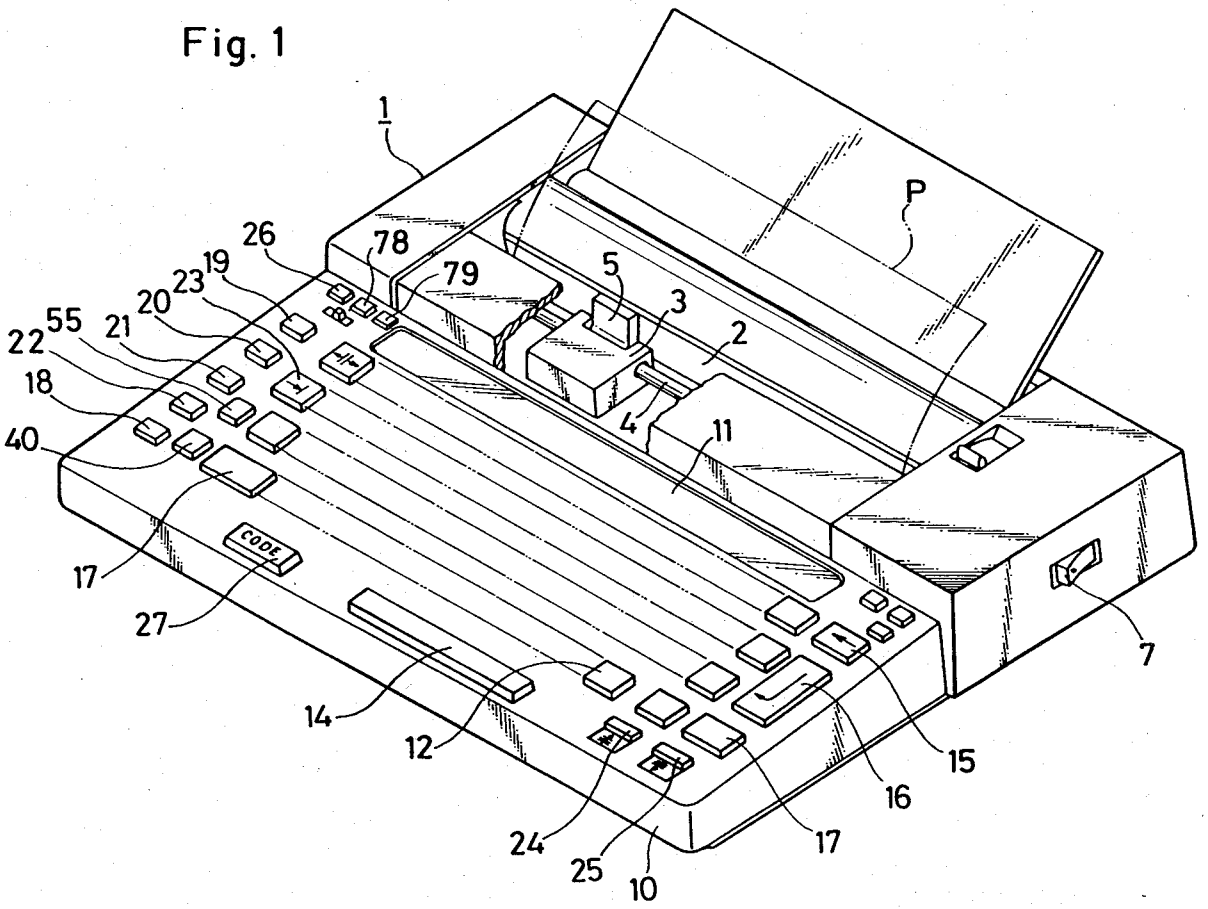
Figure 2:
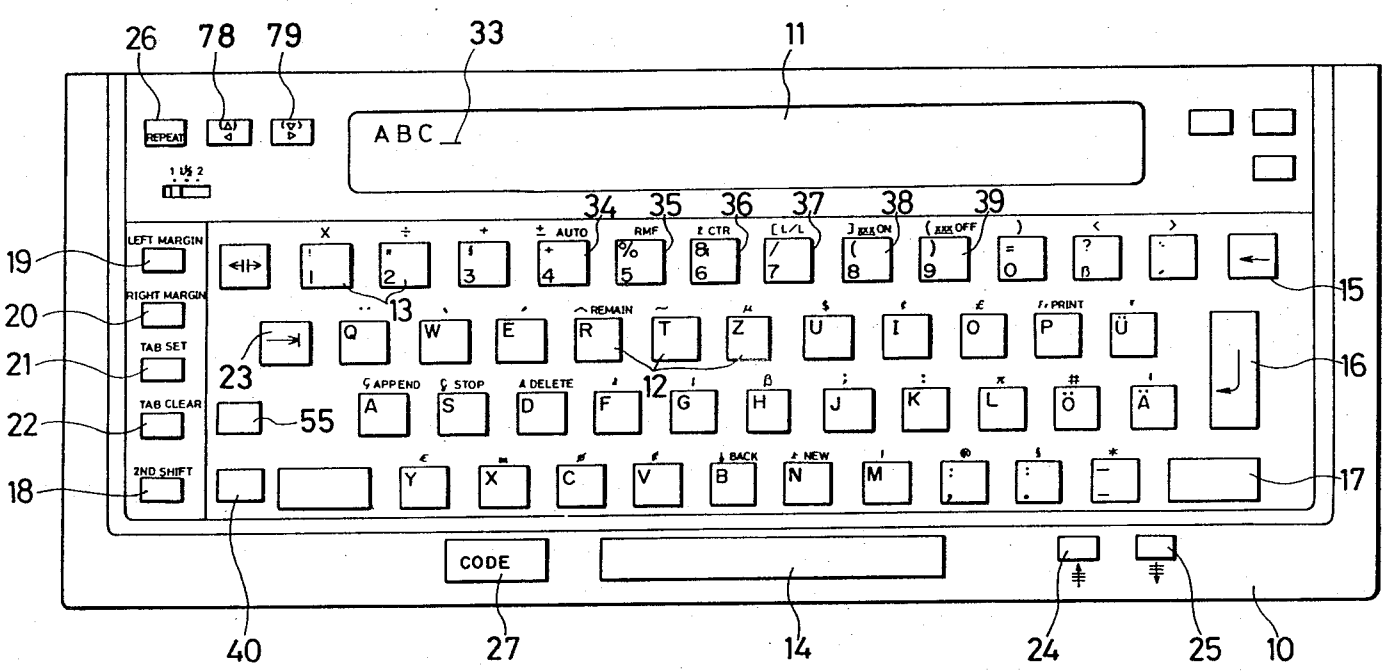

As shown in FIG. 1, on the rear side of a body case 1 of the typewriter, a platen 2 is supported, on its front side there is arranged a guide rod 4 extending in parallel to the platen 2. On the guide rod 4, a carriage 3 is supported movably in both directions along the platen 2. On the carriage 3, there is mounted a thermal head 5 which is adapted to change over its position between a print position pressed onto a print paper P in front of the platen 2, and a non-print position spaced forwardly from the print paper P.

Also, in front portion of the body case 1, a key-board 10 is provided, whereon a liquid crystal display (LCD) 11 displaying 3 lines each consisting of 80 characters corresponding to the number of print characters of one line is disposed.

Moreover, on the key board 10, following operating members such as various keys, change over switches and the like for operating the typewriter are arranged. That is to say, there are provided, character and symbol keys including alphabetical keys 12, numeral keys 13 and a space key 14, a back space key 15, a carriage return key 16, a shift key 17, a second shift key 18, a left margin set key 19, a right margin set key 20, a tab set key 21, a tab clear key 22, a tab key 23, a paper feed key 24, a paper return key 25, a repeat key 26, a code key 27, cursor shift keys 78, 79 for shifting a cursor 33 on the display 11 to show the data input position and the like.

Meanwhile, explanation on other keys will be omitted, since they are installed on a conventional typewriter.

Also, as to a carriage shifting mechanism which moves the carriage 3 having the thermal head 5 right and left in both directions and a ribbon feed mechanism incorporated in the carriage 3, constructions are as same as that disclosed in Japanese Patent Publication No. 60-87085 whereby a windingspool is rotated to wind a thermal transfer ribbon when the carriage moves to the printing direction, but the winding spool is not rotated when the carriage 3 moves to the counter printing direction by holding the thermal head 5 at the non-print position.

With respect to the concrete structure of the carriage shifting mechanism and the ribbon feed mechanism, the detailed explanations are omitted.

Figure 3:
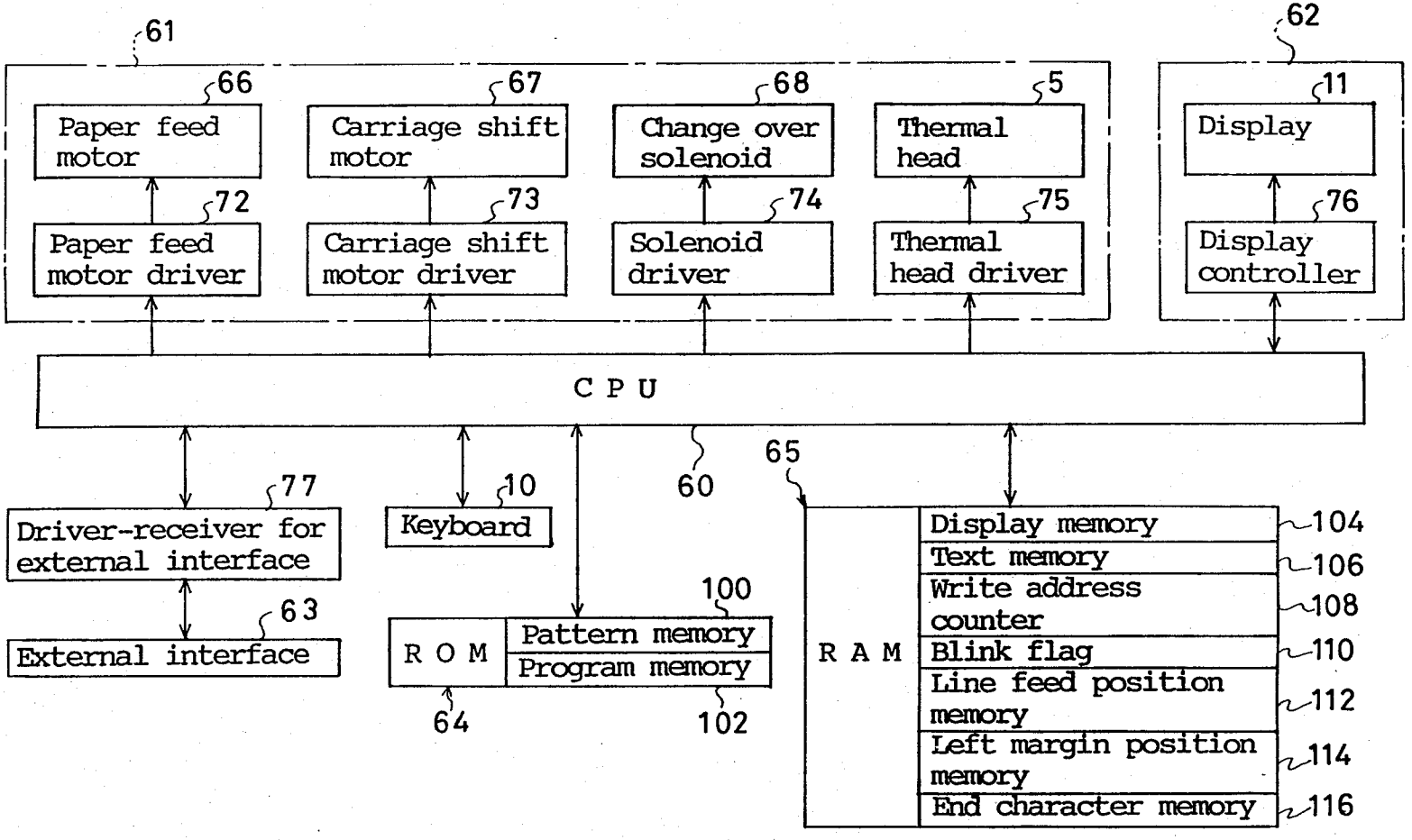

Next, a control system of above-mentioned electronically controlled typewriter will be explained with reference to the block diagram shown in FIG. 3.

A printing mechanism 61, a display mechanism 62, a driver receiver 77 for external interface connected to an external interface 63, the key-board 10, a ROM (read only memory) 64 and a RAM (random access memory) 65 are connected to a CPU (central processing unit) 60 as shown in the diagram.

The printing mechanism 61 includes a paper feed motor 66 for driving a paper feed roller and a paper feed motor driver 72 for driving a paper feed motor driver 72, a carriage shifting motor 67 for shifting the carriage 3, and a carriage shifting motor driver 73, a change over solenoid 68 for selectively changing over the thermal head 5 between the printing and non-printing positions and a solenoid driver 74, the thermal head 5, a thermal head driver 75 and so on.

The display mechanism 62 is constituted by the display (liquid crystal display) 11 and a display controller 76.

The ROM 64 includes a pattern memory 100 in which pattern data of each character and symbol are stored, and a program memory 102 in which a control program for controlling the print mechanism 61 and display mechanism 62 and a control program for the wordlap control to be described later are stored.

In the RAM 65, there are provided a display memory 104 for storing input data for at least three lines corresponding to the print position, a text memory 106 which receives data of every print line overflowing in sequence from the display memory 104 to store in sequence correspondingly to the memory address of the display memory 104, a blink flag 110 which is set when a word consisting of a plurality of characters is automatically divided at the right margin position and separated in two lines, a write address counter 108 which indicates the write position (address) when input data are written into the display memory 104 in sequence, a line feed position memory 112 which stores the line feed position (address) when the right margin set position (line feed position) is set, a left margin position memory 114 which stores the position (address) when the left margin set position is set, an end character memory 116 which stores the end character address in the display memory 104 of the end character of the word just before a space code on the basis of data of the write address counter 108 and the space code following the word data, and a various memories necessary for controlling the print mechanism 61 and display mechanism 62 and the like.

The CPU 60 makes the display memory 104 of the RAM 65 to store code data corresponding to each character and symbol such as alphabets, numerals and spaces inputted from the character and symbol keys on the key-board in sequence, and at the same time, the CPU 60 reads out pattern data corresponding to these code data in sequence from the pattern memory 100 of the ROM 64 outputs to the display controller 76, thermal head driver 75 and carriage shift motor driver 73.

Furthermore, the CPU 60, by processing code data inputted from various function keys on the key-board 10 with the control program read out from the program memory 102 of the ROM 64, outputs control signals corresponding to the input code data to the paper feed motor driver 72, carriage shift motor driver 73, solenoid driver 74 and display controller 76.

By the way, the present invention is characterized by the wordlap control which blinks the word separated at the right margin set position and displayed in two lines, moves and displays the entire word in the following line after inputting the space following the end character of the word. In order to help to understand the flow chart more clearly, outline of the wordlap control will be described.

The right margin set position defined in the embodiment, however, is a print forbidden first print position located next to a printable utmost right end print position.

Figure 4:
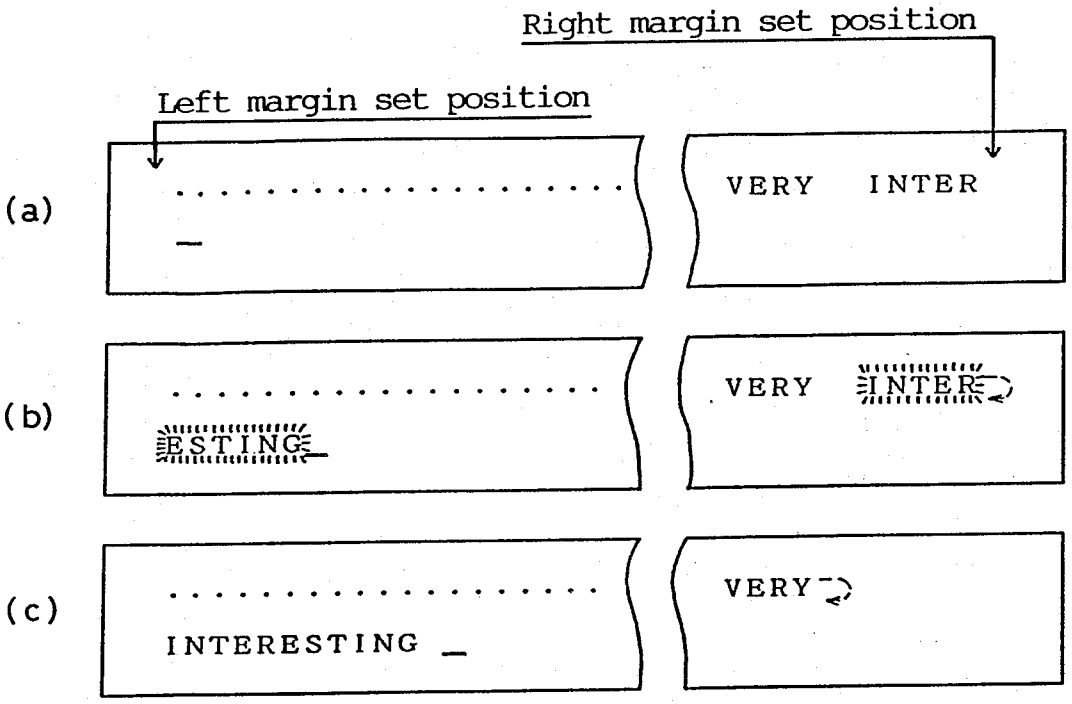

FIG. 4 shows wordlap sequences of the word displayed on the liquid crystal display 11.

As shown in FIG. 4(*a*), the cursor reached to the right margin set position after inputting "INTER" of the word "INTERESTING", and as shown in FIG. 4(*b*), the word stays blinking and its position is unchanged till the remaining spelling "ESTING" and space is inputted.

At this time, a soft return for starting a new line automatically is written after "INTER".

As shown in FIG. 4(*c*), when the space is inputted, an entire word "INTERESTING" is shifted to the following line, which is displayed from the left margin set position and its blinking is suspended.

At this time, the soft return included in the word "INTERESTING" is erased and written automatically after an utmost end character "Y" of the preceding line.

In the CPU 60, when data of the space code or end character of the word is not written in the address lower (opposite to the printing direction) by one character than the line feed position in the display memory 104, it is determined that the word being inputted at present is displayed in two lines, the wordlap control program is read in from the ROM 64, the control signal is outputted to the display controller 76, which after receiving the control signal, outputs the drive signal for switching the displaying signal on and off to the liquid crystal display 1, thereby the word is displayed with blinking.

Figure 5:
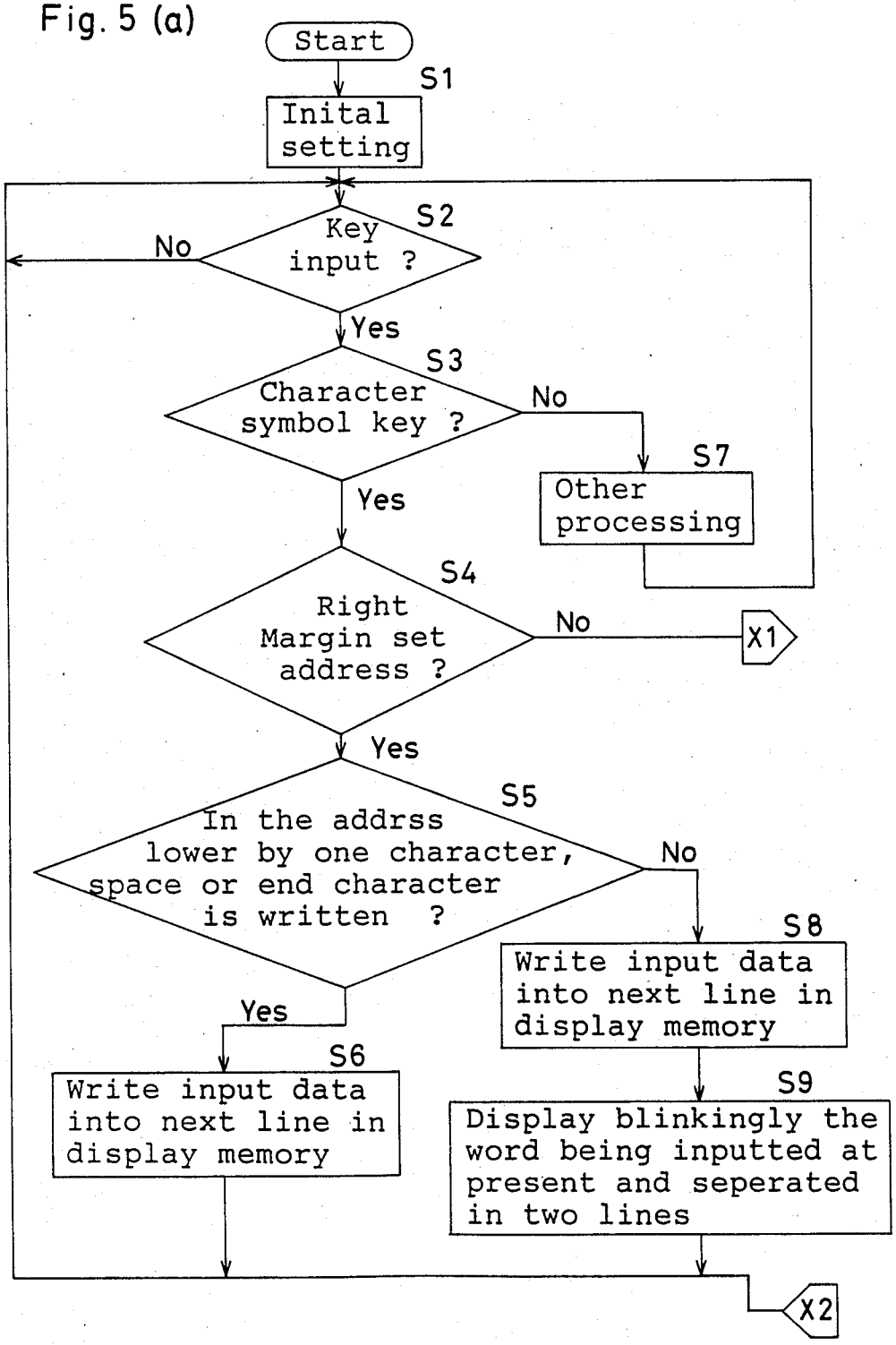
Figure 5:
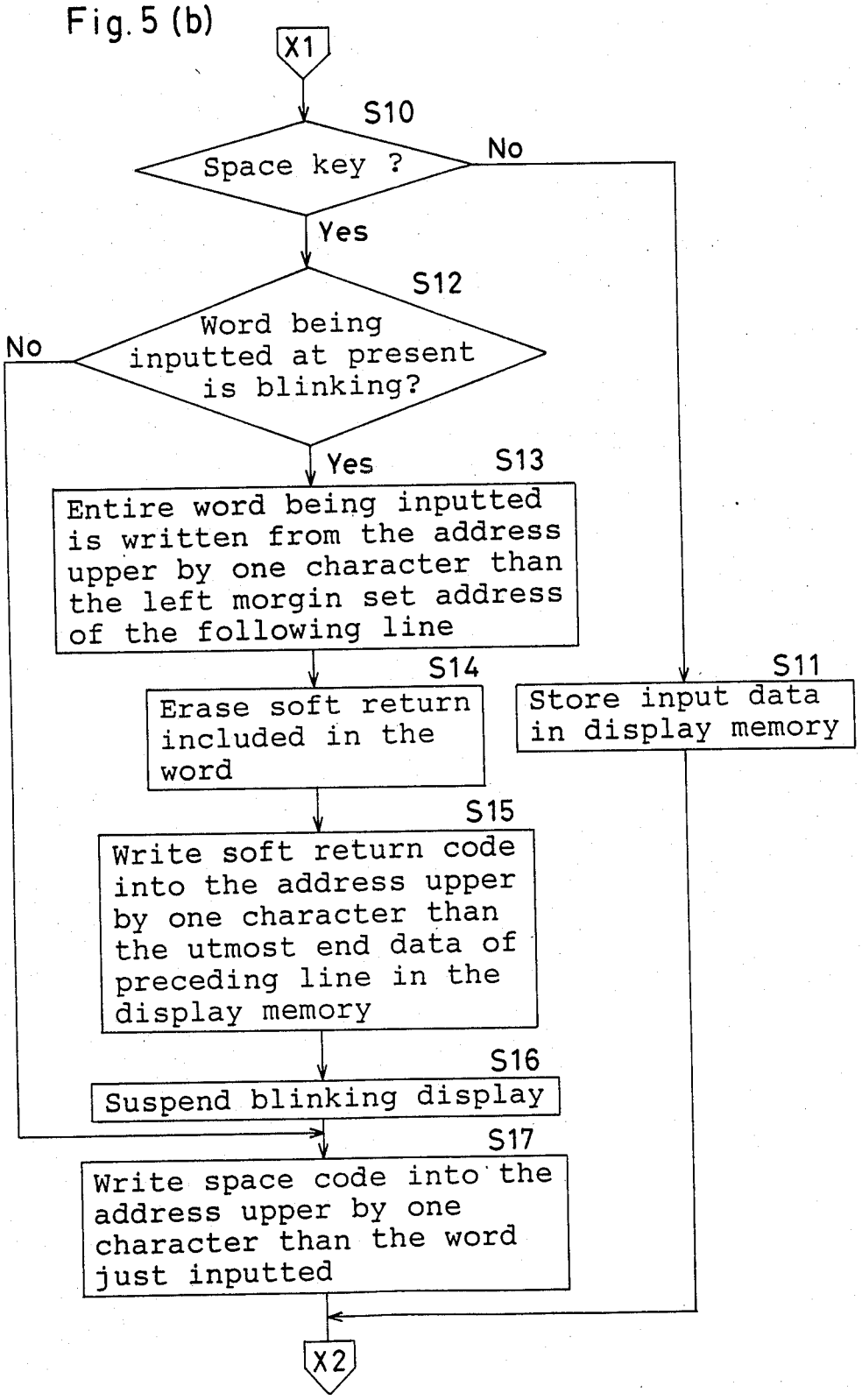

Now, a flow chart of the wordlap control performed in the control system of the typewriter will be explained with reference to FIG. 5 in which S1 through S17 shows respective step.

When the typewriter is energized, the control is started and in S1 an initial setting is conducted and S2 is performed continually.

In S2, it is determined whether or not a key input is carried out (whether or not a key is operated), when the key is not operated, S2 is repeated at intervals of very short time period till it is operated, then control moves to S3.

In S3, it is determined whether or not character symbol keys are operated, when the character symbol keys are operated it moves to S4, when the character symbol keys are not operated it moves to S7 to perform the other processing such as processing corresponding to a function key being operated and it returns from S7 to S2.

In S4, it is determined whether or not the address for writing the input data into the display memory 104 on the basis of data of the write address counter 108 and line feed position memory 112 of the RAM 65 is the right margin set address (position), when it is the right margin set address control moves to S5, when not it moves to S10.

In S5, it is determined whether or not the address lower by one character (in the direction of left margin set address) than the line feed position of the line feed position memory 112 is set in the write address counter 108, and the space code is written into the address in the display memory 104 indicated by the write address counter 108, or the end character data of the word is written on the basis of the data in the end character memory 116, that is, head character of the next word is possible to be written from the address upper by one character than the left margin set address of the following line, if Yes it moves to S6, if No it moves to S8.

In S6, inputted data is written into the address upper (in the direction of right margin set address) by one character than the left margin set address of the following line in the display memory 104, and it moves from S6 to S2.

Then, when it is determined No in S5, it moves from S5 to S8, where the first remaining data of the word automatically started in a following new line is written into the address upper by one character than the left margin set address of the following line in the display memory 104.

In next S9, 1 is written into the blink flag 110 of the RAM 65 to show a blink mode, and the word separated in two lines is displayed blinkingly on the liquid crystal display 11, then it moves from S9 to S2.

In the case aforementioned, the CPU outputs the control signal to the display controller 76 relative to the word separated and displayed in two lines on the basis of the blink control program included in the wordlap control program of the ROM 64.

In S10, it is determined whether or not a key operated is the space key 14, when it is the space key 14 (when the space is inputted after word input) it moves to S12, when it is not, that is, or when it is the character or symbol key other than the space key 14 and possible to be printed, it moves to S11. In next S11, input data is written into the display memory 104, and then it moves from S11 to S2.

Each address in the display memory 104 is corresponding to each display position (however, each display position is corresponding to the print position) of the liquid crystal display 11, and the data written into the display memory 104 is displayed on the liquid crystal display 11.

Input data are displayed in sequence till the right margin set address on the liquid crystal display 11 is achieved by repeating **S2*S4 and S10*S11**.

Then, when display position of the input data coincides with the right margin set address, it moves from S4 to S5, and when the word is separated and displayed in two display lines, it moves from S5 to S9 via S8, in S9 blinking display is started with respect to the separated word being inputted at present. Then, it moves from S10 to S12 when **S2*S4 and S10*S11** are repeated and the space following the end of separated word is inputted.

In S12, it is determined whether or not the word being inputted at present is displayed blinkingly on the basis of the data from the blink flag 110 (that is, whether or not separated and displayed in two lines), when it is displayed blinkingly it moves to S13, when not it moves to S17.

In next S13, on the basis of data of the left margin position memory 114, by writing the address upper by one character than the left margin set address of the following line into the write address counter 108, the entire word just inputted and separated in two lines is written in sequence from the address upper by one character than the left margin set address of the next line in the display memory 104.

In next S14, the soft return code for automatic line feed included in the word just shifted to the following line in the display memory 104 is erased.

In next S15, by writing the address upper by one character than the utmost end data of the preceding line in the display memory 104 into the write address counter 108, the soft return code for automatic line feed is written into the address in the display memory; 104 indicated by the write address counter 108.

In next S16, after releasing the blink mode and suspending the blinking display by writing O into the blink flag 110, it moves from S16 to S17.

In next S17, in the display memory 104, on the basis of write address counter 108, the space code is written into the address by one character more than the word (word shifted to the following line) just inputted, it moves from S17 to S2, thereafter each step is repeated.

As described hereinabove, though the word being inputted is separated and displayed in two lines on the liquid crystal display 11 at the right margin set position, the word is only displayed blinkingly and is not shifted to the following line before its data input is completed, but the entire word is wordlapped in the following line after the space following the word is inputted, so that the word is not shifted suddenly to the following line during input of its data, thus operator's bewildering can be avoided.

Meanwhile, in place of blinking display of the word separated in two lines, the negative display, underline display or brilliance variable display may be performed, in effect, it is enough for the operator to notice that the word will be shifted to the following line.

Also, though the embodiment has been described regarding the electronic typewriter, it will be appreciated that it is similarly applicable to a word processor including a CRT.

We claim:

1. A document processor comprising:

input means for inputting code data of characters and symbols, and various command data, display means for displaying characters and symbols inputted from said input means on a display having at least two display lines, control means for controlling said display means, including data memory for storing data to be displayed by said display means, wordlap determining and command means for determining data inputted at an utmost right position regulated by a right margin set position on said display means is data of a character other than an end character of a word, and for outputting a wordlap command when said data in said data memory is representative of a character other than said end character of a word, distinguishing display command means for outputting a distinguishing display command to said control means, when receiving said wordlap command from said wordlap determining and command means, for commanding a distinguishable display of the data as a word separated at said right margin set position and displayed on two display lines of said display, and wordlap control means for commanding said control means to display all characters of said separated word on the succeeding display line of said display from the left utmost position regulated by a left margin set position, after inputting the end character of said separated word.

2. A document processor according to claim 1, wherein said document processor further comprises a printing means for printing characters and symbols on a printing medium, and said printing means is controlled by said control means.

3. A document processor according to claim 2, wherein said control means further comprises a text memory for receiving data supplied from said display memory and for storing data to be printed by said printing means.

4. A document processor according to claim 1, wherein said distinguishing display command is a signal to blink the word separated into two lines.

5. A document processor according to claim 1, wherein said wordlap determining and command means is provided with a means for discriminating whether or not space code data or end character data of a word is written in the address lower by one character than said right margin set position in said display memory.

6. A document processor according to claim 1, wherein said display means is provided with a liquid crystal display.

7. A document processor according to claim 1, wherein said display means is provided with a CRT display.

* * * * *